US006145845A

United States Patent [19]

Tremoulet, Jr. et al.

[11] Patent Number: 6,145,845

[45] **Date of Patent: *Nov. 14, 2000**

[54] BIASED SEAL ASSEMBLY FOR HIGH PRESSURE FLUID PUMP

[75] Inventors: Olivier L. Tremoulet, Jr., Edmonds; Chidambaram Raghavan; Katherine M. Madden, both of Kent, all of Wash.

[73] Assignee: Flow International Corporation, Kent, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 09/071,706

[22] Filed: May 1, 1998

Related U.S. Application Data

[63] Continuation-in-part of application No. 08/932,690, Sep. 18, 1997, Pat. No. 6,086,070.

[51] Int. Cl.[7] ..... F16J 15/18

[52] U.S. Cl. ..... 277/522; 277/557

[58] Field of Search ..... 277/500, 510, 277/522, 557, 589, 607; 92/168

[56] References Cited

U.S. PATENT DOCUMENTS

| | | | |
|---|---|---|---|
| 1,289,974 | 12/1918 | Van Dervort | 277/505 |
| 1,443,675 | 1/1923 | Bowler | 137/540 |
| 1,624,798 | 4/1927 | Neilson | 277/339 |
| 2,020,122 | 11/1935 | Padgett | 384/15 |
| 2,059,759 | 11/1936 | Stearns | 137/153 |
| 2,429,578 | 10/1947 | Gleasman | 251/144 |
| 3,550,617 | 12/1970 | Johnson | 137/514.5 |
| 3,602,520 | 8/1971 | Wallis | 277/557 |
| 3,776,558 | 12/1973 | Maurer et al. . | |
| 4,350,179 | 9/1982 | Bunn et al. | 137/540 |
| 4,448,574 | 5/1984 | Shimizu | 417/488 |
| 4,620,562 | 11/1986 | Pacht | 137/315 |
| 4,637,419 | 1/1987 | Hughes | 137/236.1 |
| 4,832,352 | 5/1989 | Sjostedt | 92/168 |
| 5,050,895 | 9/1991 | Hashish et al. | 92/168 |
| 5,364,111 | 11/1994 | Wunsch | 277/557 |
| 5,493,954 | 2/1996 | Kostohris et al. | 92/168 |
| 5,564,469 | 10/1996 | Tremoulet, Jr. et al. | 137/540 |
| 5,593,166 | 1/1997 | Lovell et al. | 277/516 |
| 5,927,323 | 7/1999 | Kikuchi et al. | 137/514.5 |

FOREIGN PATENT DOCUMENTS

| | | |
|---|---|---|
| 368391 | 3/1929 | Belgium . |
| 0 870 956 A1 | 10/1998 | European Pat. Off. . |
| 1057367 | 3/1954 | France . |
| 35 38 307 A1 | 5/1986 | Germany . |
| 35 34 149 C1 | 1/1987 | Germany . |
| 58-221081 | 12/1983 | Japan . |
| 53-33941 | 12/1993 | Japan . |
| 1407874 | 10/1975 | United Kingdom . |

*Primary Examiner*—Anthony Knight
*Assistant Examiner*—Alison K. Pickard
*Attorney, Agent, or Firm*—Seed IP Law Group PLLC

[57] ABSTRACT

A method and apparatus for biasing a seal assembly in a high pressure fluid pump. In one embodiment, the fluid pump includes a reciprocating plunger, a seal carrier disposed about the plunger, and a seal supported by the seal carrier and sealably engaged with the plunger. The seal may be biased toward the seal carrier with a spring and may include a flange that engages the spring to restrict lateral motion of a spring relative to the reciprocating plunger. The flange may engage an inner and/or an outer surface of the spring. Where the spring is a coil spring, the flange may be continuous around the circumference of the spring or may include a plurality of spaced apart projections located around the circumference of the spring.

27 Claims, 5 Drawing Sheets

BIASED SEAL ASSEMBLY FOR HIGH PRESSURE FLUID PUMP

CROSS-REFERENCE TO RELATED APPLICATION

This application is a continuation-in-part of U.S. patent application Ser. No. 08/932,690, filed Sep. 18, 1997, now U.S. Pat. No. 6,086,070.

TECHNICAL FIELD

This invention relates to seals for high pressure fluid pumps having reciprocating plungers.

BACKGROUND OF THE INVENTION

In high pressure fluid pumps having reciprocating plungers, it is necessary to provide a seal around the plunger to prevent the leakage of high pressure fluid. In such pumps, the seal must be able to operate in a high pressure environment, withstanding pressures in excess of 10,000 psi, and even up to and beyond 50,000–70,000 psi.

Currently available seal designs for use in such an environment include an extrusion resistant seal that seals against the plunger and is supported by a back-up ring. The back-up ring and seal may be supported by a seal carrier and may be biased toward the seal carrier with a coil spring that encircles the plunger. The spring may be held in place against the seal with a collar that has a bore through which the plunger passes and that has a flange encircling one end of the spring.

One problem with current seal designs is that the tolerances for clearance between the plunger and the back-up ring may be very difficult to achieve and maintain. Very typically, therefore, the plunger and the back-up ring come into contact, generating frictional heating, which in turn may cause the seal to fail. Another problem with current seal designs is that components of the seal may wear over time, causing fluid to leak around the plunger.

SUMMARY OF THE INVENTION

The present invention is directed toward methods and apparatuses for sealing components of a high pressure pump having a reciprocating plunger. The apparatus may include a cylinder having a cylinder wall with at least one opening, an elongated plunger extending through the opening, and a spring disposed about the plunger. The spring may have an inner surface facing toward the plunger and an outer surface facing away from the plunger. The assembly may further comprise a seal having a sealing surface that seals against the plunger and an engaging surface that engages at least one of the inner and outer surfaces of the spring to restrict lateral motion of the spring relative to the plunger.

The seal may have several shapes. For example, the seal may include a continuous flange that extends around to the circumference of the spring. Alternatively, the seal may include a plurality of spaced-apart projections that engage the spring. In a further embodiment, the flange may have a first engaging surface adjacent the inner surface of the spring and a second engagement surface adjacent the outer surface of the spring.

The present invention is also directed toward a method for restricting motion of a spring disposed about a plunger of a high pressure pump. The method may comprise sealably engaging a seal with the plunger, engaging the seal with at least one of the inner surface and the outer surface of the spring toward one end of the spring, and restricting lateral motion of the spring relative to the plunger. Alternatively, the method may include engaging both the inner and outer surfaces of the spring, and may further include engaging an opposite end of the spring. Where the spring is a coil spring, the method may include engaging a portion of one coil of the spring corresponding to half a diameter of a filament that comprises the spring, or may include engaging more than one coil of the spring.

DETAILED DESCRIPTION OF THE INVENTION

Figure 1:
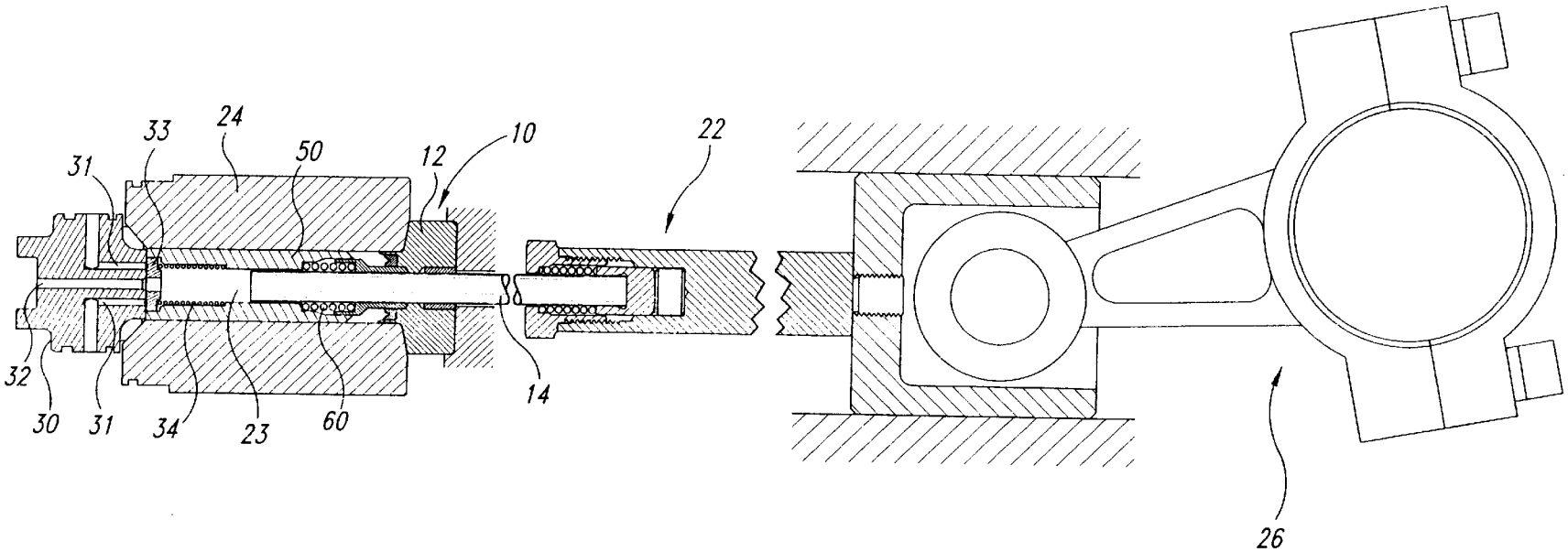
FIG. 1 is a partial cross-sectional plan view of a pump assembly having a seal carrier and seal in accordance with an embodiment of the invention.

A high pressure fluid seal assembly 10 is provided in accordance with one embodiment of the present invention, as illustrated in FIG. 1. The seal assembly 10 is for use in a high pressure pump assembly 22 having a reciprocating plunger 14 coupled to a drive mechanism 26. The plunger 14 reciprocates in a high pressure cylinder 24. The seal assembly 10 is positioned adjacent the plunger 14 at one end of the cylinder 24 to restrict and/or prevent the leakage of high pressure fluid from a high pressure region 23 within the high pressure cylinder 24. A check valve 30 at the opposite end of the cylinder 24 includes a plurality of inlet ports 31, an outlet port 32, and a poppet 33 that seals the inlet ports. The check valve 30 directs fluid through the inlet ports 31 and into the cylinder 24 when the plunger 14 partially withdraws from the cylinder during an intake stroke. The check valve 30 directs pressurized fluid out of the cylinder 24 through the outlet port 32 when the plunger 14 moves into the cylinder during a pressure stroke.

A collar or retainer 50 may be located within the cylinder 24 between the seal assembly 10 and the check valve 30 to reduce the volume within the cylinder and thereby increase the pressure generated with each pressure stroke of the plunger 14. The collar 50 also applies a biasing force to the poppets 33 via a poppet spring 34 and to the components of the seal assembly 10 via a seal spring 60, as will be discussed in greater detail below.

Figure 2:
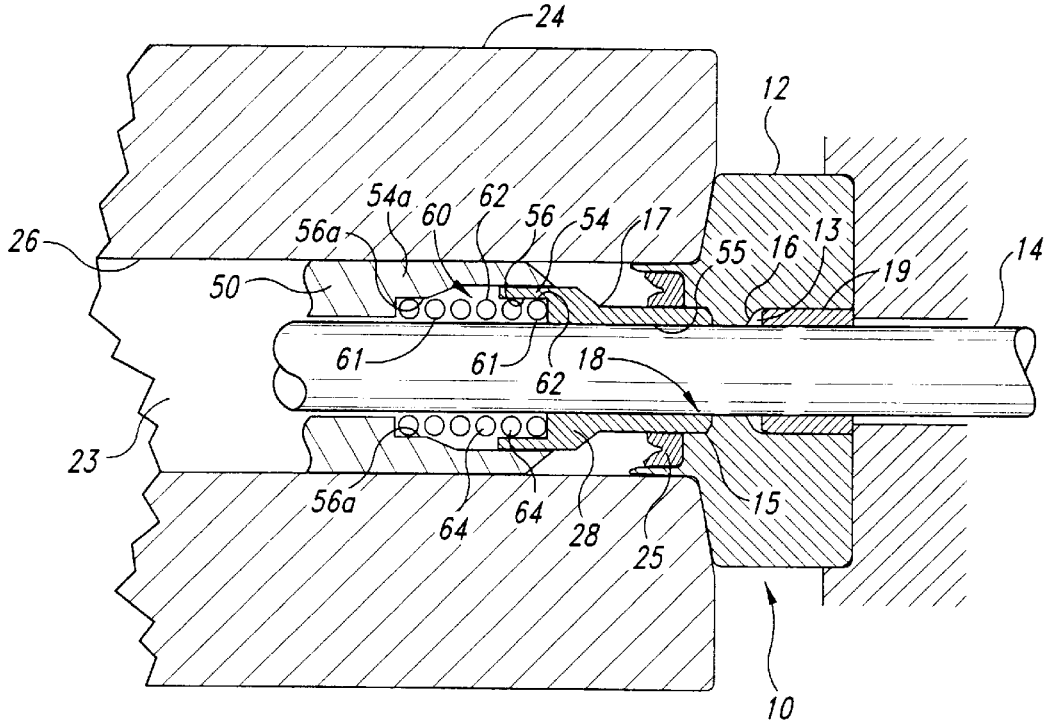
FIG. 2 is an enlarged partial cross-sectional plan view of the seal and seal carrier illustrated in FIG. 1.

As illustrated in FIG. 2, the seal assembly 10 includes a seal carrier 12 having a bore 13 through which the reciprocating plunger 14 passes. The seal carrier 12 has a first annular groove 15 in which an annular seal 17 is positioned. The annular seal 17 has a sealing surface 55 that seals against the plunger 14. An annular elastomeric seal 25 is provided around the outer circumference of annular seal 17, to energize the annular seal 17 during the start of the pressure stroke. The seal spring 60 engages the annular seal 17 and urges it toward the first annular groove 15 to restrict motion of the annular seal 17 away from the seal carrier 12. The seal carrier 12 has an integral, annular guidance bearing 19 that is positioned in a second annular groove 16 within the bore 13. The second annular groove 16 and the guidance bearing 19 positioned therein are axially spaced apart from the first annular groove 15 and the annular seal 17 contained therein.

Figure 3:
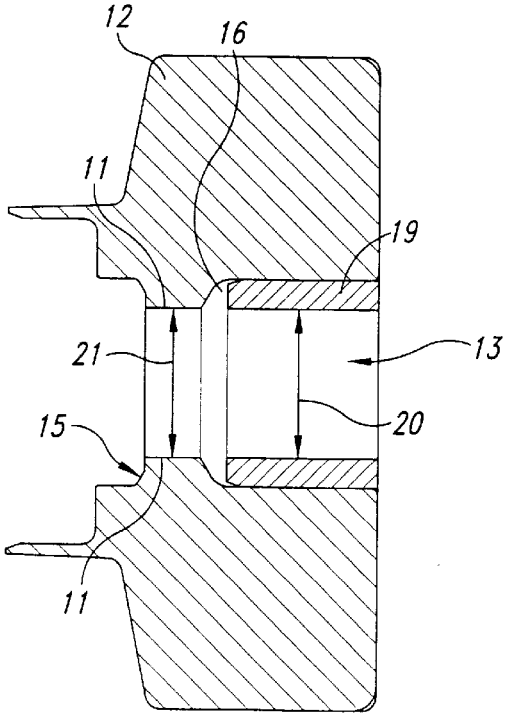
FIG. 3 is a detailed cross-sectional plan view of the seal carrier illustrated in FIGS. 1 and 2.

FIG. 3 is a detailed cross-sectional view of the seal carrier 12 and the guidance bearing 19 shown in FIG. 2. As shown in FIG. 3, an inner diameter 20 of the guidance bearing 19 is smaller than an inner diameter 21 of the seal carrier bore 13 in a region 11 between the seal 17 (FIG. 2) and the guidance bearing 19. For example, in one embodiment, the inner diameter 20 is 0.0005–0.0015 inch smaller than the inner diameter 21. In this manner, an end region 18 (FIG. 2) of the annular seal 17 is supported by region 11 of the seal carrier 12; however, the region 11 of seal carrier 12 is not in contact with the plunger 14, because the diameter 21 of the bore 13 in region 11 is greater than the inner diameter 20 of the guidance bearing 19.

An embodiment of the seal assembly 10 shown in FIGS. 1–3 therefore supports the seal 17 directly with the seal carrier 12, eliminating the need for a back-up ring. The integral guidance bearing 19 prevents the plunger 14 from contacting the seal carrier 12, thereby reducing frictional heating in the vicinity of the seal 17, which in turn extends the life of the seal. To further increase the longevity of the assembly 10, the materials for the components are selected to minimize the friction between the plunger 14 and the guidance bearing 19 and between the plunger 14 and the seal 17. In one embodiment, the plunger 14 is made of partially stabilized zirconia ceramic, the guidance bearing 19 is made of a resin impregnated graphite, and the seal 17 is made of an ultra-high molecular weight polyethylene. However, it should be noted that a variety of materials may be used, and the materials selected for one component may depend on the materials selected for another component.

To further increase the reliability of the seal 17, the seal assembly 10 is preferably manufactured by pressing the guidance bearing 19 into the seal carrier 12, and machining the bore 13 through the guidance bearing and through region 11 of the seal carrier in the same machining setup. As discussed above, the inner diameter of the bore 13 in region 11 is machined slightly larger than the inner diameter 20 of the bore through the guidance bearing. However, by machining both areas in the same setup, the concentricity of the elements is improved, as compared to prior art systems wherein elements of a seal assembly are machined independently and then assembled.

Returning to FIG. 2, the seal 17 may be biased toward the seal carrier 12 by the seal spring 60, as discussed above. In one embodiment, the seal spring 60 may include a wire filament coiled about the plunger 14 to form a plurality of coils 64 that encircle the plunger. Each coil 64 may have an inner surface 61 facing the plunger 14 and an outer surface 62 facing away from the plunger. In other embodiments, the seal spring 60 may have other shapes that also bias the annular seal 17 toward the seal carrier 12.

It has been found that the seal springs may flex transverse to the axis of the plunger 14 and rub against either the plunger or the collar 50. Accordingly, the seal springs may wear down and may place an uneven load on the seals against which the seal springs bear, causing the seals to leak. Alternatively, the seal springs may cause either the collar 50 or the plunger 14 to wear, reducing the useful life of these components.

One approach to addressing the spring wear problem has been to increase the size of the bore through the collar 50, reducing the likelihood that the outer surface of the seal springs will contact the inner surface of the bore. One problem with this approach is that the seal springs may flex transversely by a greater amount when positioned in the larger bore. Therefore, even if the outer surface of the seal spring does not contact the inner surface of the bore, the inner surface of the spring may be more likely to contact the plunger 14, causing the seal spring and the plunger to wear and placing an uneven load on the seal.

Accordingly, in one embodiment of the present invention, the annular seal 17 may include a body 28 and an annular flange portion 54. The flange portion 54 extends away from the body concentric with the seal spring 60, the plunger 14 and the annular seal 17, and engages the outer surface 62 of the seal spring. For example, the flange portion 54 may have an engaging surface 56 that engages two of the coils 64 of the seal spring 60. Accordingly, the engaging surface 56 may be curved to correspond to the curved shape of the coils 64. In other embodiments, the engaging surface 56 may engage more or fewer coils 64 and/or other portions of the seal spring 60, as is discussed in greater detail below with reference to FIGS. 4–9. In further alternate embodiments, the engaging surface 56 may engage seal springs 60 having shapes other than the axisymmetric coiled shape shown in FIG. 2.

An advantage of the seal 17 and the flange portion 54 is that they may engage the outer surface 62 of the seal spring 60 and restrict motion of the seal spring transverse to the axis of the plunger 14. Accordingly, the seal spring 60 may be less likely to contact the plunger 14 and/or the collar 50, potentially increasing the life of the plunger, the collar, and the seal spring. Furthermore, by reducing friction between the seal spring 60, the plunger 14, and the collar 50, the heat generated in the cylinder 24 may be reduced, thereby increasing the life of the seal 17.

As shown in FIG. 2, the collar 50 may include a flange portion 54*a* having an engaging surface 56*a*. The engaging surface 56*a* may be positioned to engage the outer surface 62 of the seal spring 60, opposite the portion of the seal spring engaged by the engaging surface 56 of the seal 17. By engaging the outer surface 62 of both ends of the seal spring 60, the collar 50 and the seal 17 may together further reduce the likelihood that the seal spring 60 will move transverse to the plunger 14, and may further increase the life of the components of the seal assembly.

Figure 4:
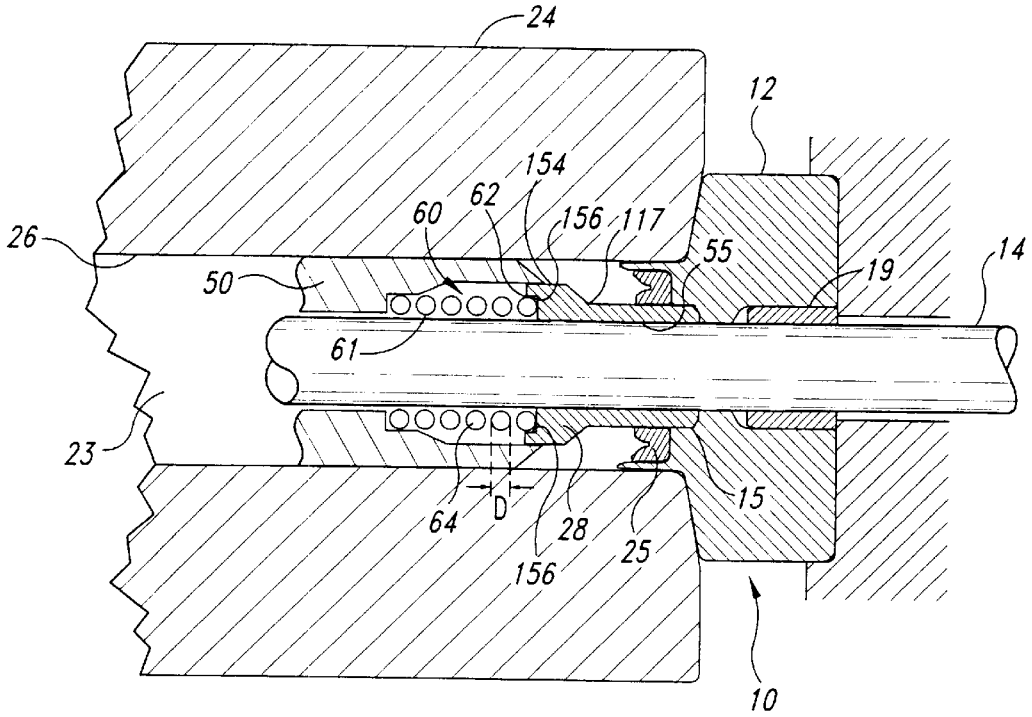
FIG. 4 is a partial cross-sectional plan view of a seal assembly having a seal that engages an outer surface of a spring in accordance with another embodiment of the invention.

FIG. 4 is a partial cross-sectional plan view of a seal assembly 10 having a seal 117 with a shortened annular flange 154 in accordance with another embodiment of the invention. The flange 154 has an engaging surface 156 that engages a portion of the seal spring 60 approximately equal to half a diameter D of the filament comprising the seal spring. In other embodiments, the flange 154 may engage a greater or lesser portion of the seal spring 60, so long as it engages enough of the seal spring to restrict and/or prevent lateral motion of the seal spring relative to the plunger 14. An advantage of the seal 117 when compared to the seal 17 shown in FIG. 2 is that it may require less material to manufacture.

Figure 5:
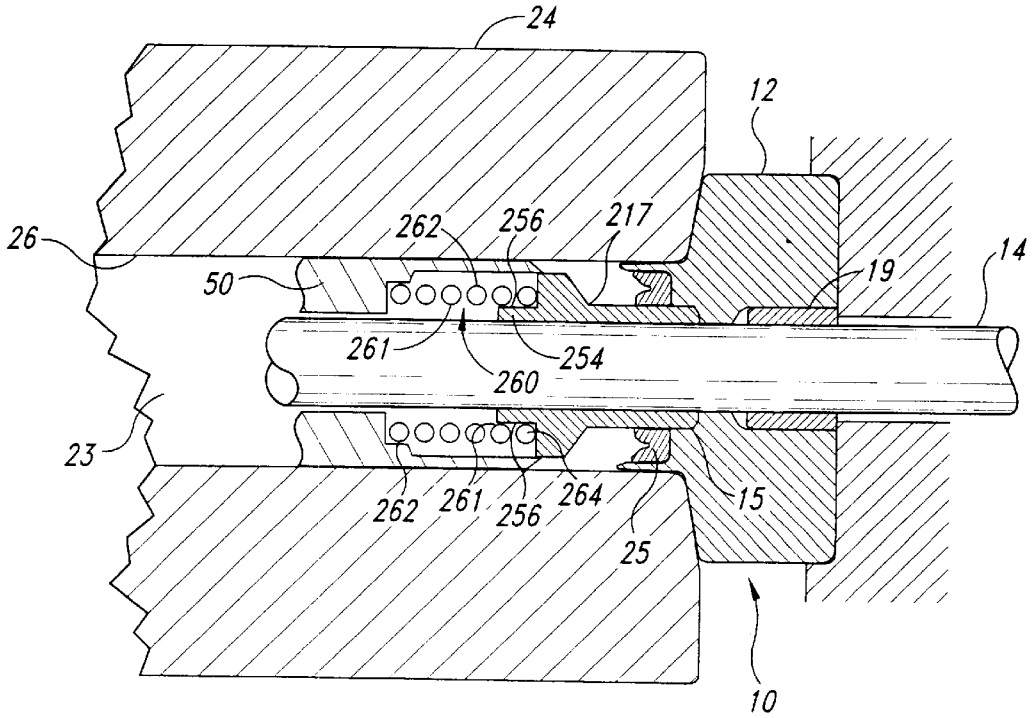
FIG. 5 is a partial cross-sectional plan view of a seal assembly having a seal that engages an inner surface of a spring in accordance with still another embodiment of the invention.

FIG. 5 is a partial cross-sectional plan view of a seal assembly 10 having a seal 217 with an annular flange 254 adjacent the plunger 14. The seal 217 may therefore sealably engage a larger portion of the plunger 14, and may accordingly provide a better seal with the plunger. The flange 254 has an engaging surface 256 that engages the inner surface 261 of a seal spring 260 to restrict and/or prevent lateral motion of the seal spring 260 relative to the plunger 14 and the collar 50. The engaging surface 256 may engage a single coil 264 of the seal spring 260, or may engage a greater or lesser portion of the spring, as discussed above with respect to FIGS. 2 and 4. The collar 50 may engage the outer surface 262 of the seal spring 260, as shown in FIG. 5, or alternatively may engage the inner surface 261 of the seal spring 260, so long as the collar 50 remains spaced apart from the plunger 14.

Figure 6:
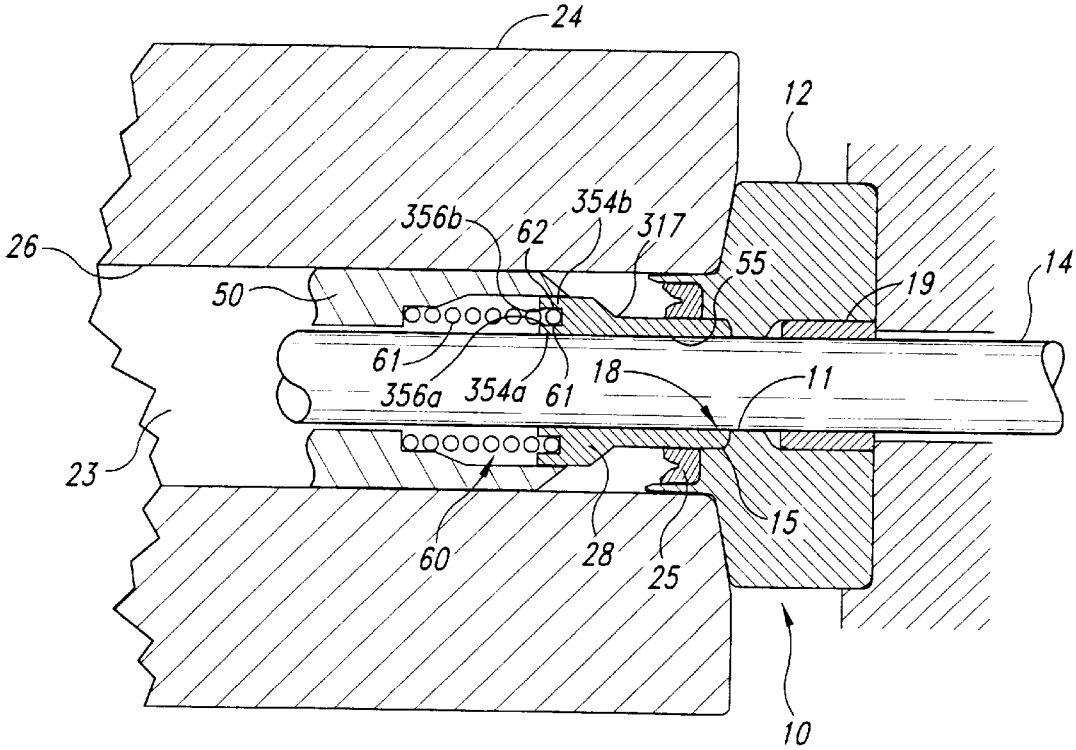
FIG. 6 is a partial cross-sectional plan view of a seal assembly having a seal that engages inner and outer surfaces of a spring in accordance with yet another embodiment of the invention.

FIG. 6 is a partial cross-sectional plan view of a seal assembly 10 having a seal 317 with an inner flange 354*a* spaced apart from an outer flange 354*b*. The inner flange 354*a* has an engaging surface 356*a* that engages the inner surface 61 of the seal spring 60, and the outer flange 354*b* has an engaging surface 356*b* that engages the outer surface 62 of the spring. Accordingly, the seal 317 may further prevent lateral motion of the spring 60 relative to the plunger 14.

Figure 7:
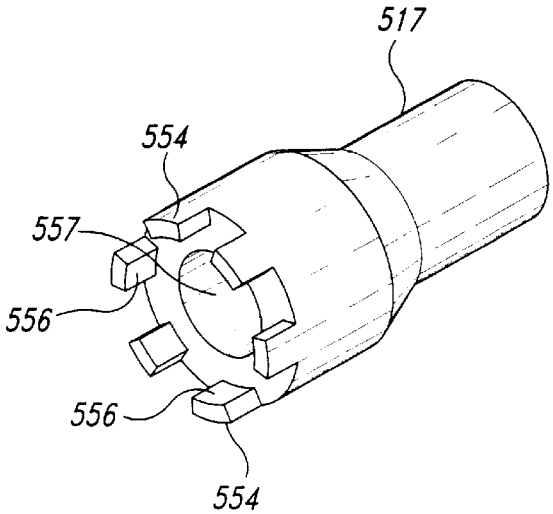
FIG. 7 is an isometric view of a seal having projections in accordance with still another embodiment of the invention.

FIG. 7 is an isometric view of a seal 517 having a plurality of engaging members 554 spaced around the circumference of a bore 557. The bore 557 may be sized to slidably engage the plunger 14 (FIG. 2) and the engaging members 554 may include engaging surfaces 556 positioned to engage the seal spring 60 (FIG. 2). In the embodiment shown in FIG. 7, the engaging surfaces 556 are configured to engage the outer surface 62 (FIG. 2) of the seal spring 60, and in other embodiments, the engaging surfaces may be configured to engage the inner surface 61 (FIG. 2) of the seal spring. In the embodiment shown in FIG. 7, the spring guide 517 may include seven engaging members 554 and may include a greater or lesser number of engaging members in other embodiments.

Figure 8:
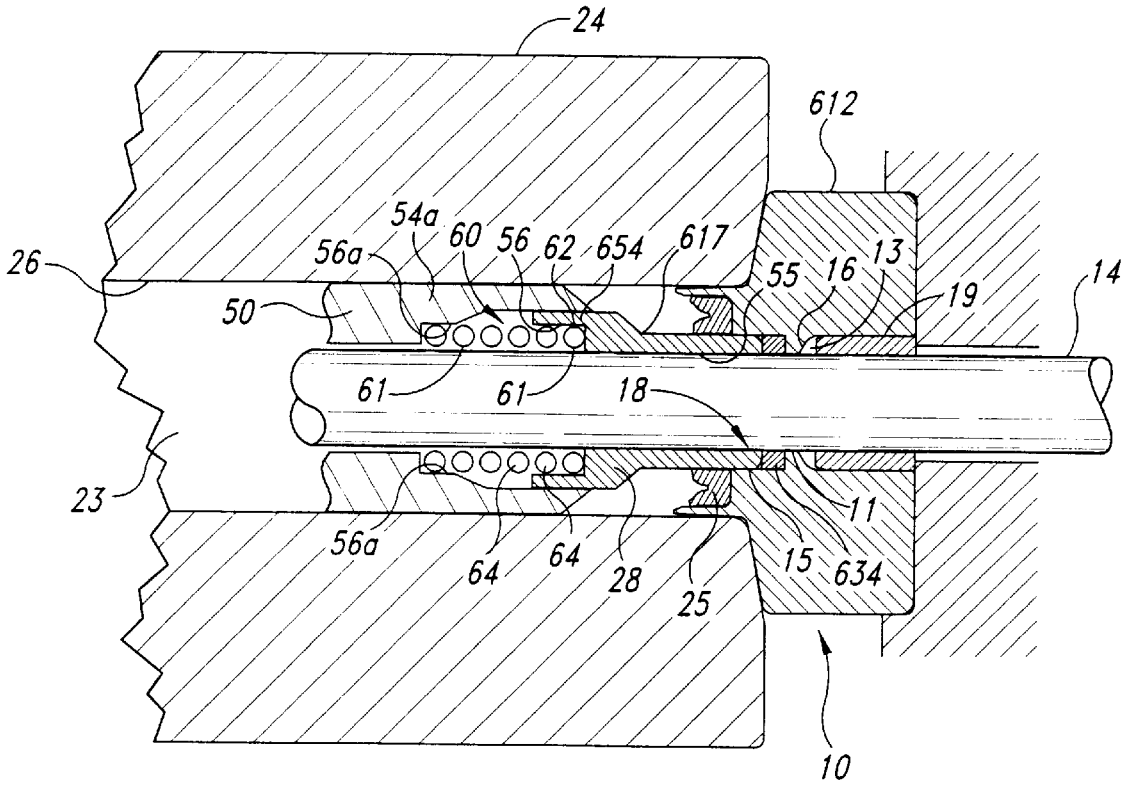
FIG. 8 is a partial cross-sectional plan view of a seal assembly having a back-up ring in accordance with yet another embodiment of the invention.

FIG. 8 is a partial cross-sectional plan view of a seal assembly 10 that includes a seal carrier 612 retaining an annular seal 617 and a back-up ring 634. The back-up ring 634 may support the annular seal 617 relative to the plunger 14. The annular seal 617 may include a flange portion 654 that engages the outer surface 62 of the seal spring 60. Alternatively, the flange portion 654 may be configured to engage the inner surface 61 of the seal spring 60 in a manner similar to that shown in FIG. 5, or both the inner and the outer surfaces 61, 62 in a manner similar to that shown in FIG. 6. In any case, the annular seal 617 may engage enough of the seal spring 60 to restrict and/or prevent contact between the seal spring 60 and one or both of the collar 50 and the plunger 14.

An improved high pressure fluid seal assembly has been shown and described. From the foregoing, it will be appreciated that, although specific embodiments of the invention have been described herein for purposes of illustration, various modifications may be made without deviating from the spirit of the invention. Thus, the present invention is not limited to the embodiments described herein, but rather as defined by the claims which follow.

What is claimed is:

1. A seal assembly for a high pressure pump, comprising:

a cylinder having a cylinder wall with at least one opening;

an elongated plunger extending through the opening of the cylinder wall;

a spring coiled around the plunger and having an inner surface facing toward the plunger and an outer surface opposite the inner surface;

a seal having a sealing surface adjacent the plunger and an engaging surface adjacent at least a portion of the outer surface of the spring to restrict lateral motion of the spring relative to the plunger; and a retaining member disposed about the plunger and engaging the spring to bias the spring toward the seal, the retaining member being spaced apart from the plunger and being in contact with an outer surface of the seal.

2. The assembly of claim 1 wherein the outer surface of the spring is curved and the engaging surface is curved and concentric with the outer surface of the spring.

3. The assembly of claim 1 wherein the spring includes a filament having a filament diameter the engaging surface of the seal extending along an axis of the plunger only by a distance approximately equal to half the filament diameter.

4. The assembly of claim 1 wherein the engaging surface of the seal is one of a plurality of engaging surfaces, each engaging surface being spaced apart from the others around the outer surface of the spring.

5. The assembly of claim 1 wherein the retaining member has an engaging surface that engages the outer surface of the spring toward the second end of the spring to restrict lateral motion of the spring relative to the plunger.

6. A seal assembly for a high pressure pump, comprising:

a cylinder having a cylinder wall with at least one opening;

an elongated plunger extending through the opening of the cylinder wall;

a spring disposed around the plunger and having an inner surface facing toward the plunger and an outer surface opposite the inner surface;

a seal having a sealing surface adjacent the plunger, the seal having an engaging surface at least proximate to at least one of the inner and outer surfaces of the spring to restrict lateral motion of the spring relative to the plunger; and a retaining member disposed about the plunger and engaging the spring to bias the spring toward the seal, the retaining member being spaced apart from the plunger and being in contact with an outer surface of the seal.

7. A. The assembly of claim 6 wherein the seal includes a seal body and a flange portion that extends away from the seal body concentric with the plunger, the engaging surface being a surface of the flange portion.

8. The assembly of claim 7 wherein the flange portion is spaced apart from the plunger and the engaging surface is adjacent the outer surface of the spring.

9. The assembly of claim 7 wherein the flange portion is adjacent the plunger and the engaging surface is adjacent the inner surface of the spring.

10. The assembly of claim 6 wherein the seal has a first engaging surface adjacent the inner surface of the spring and a second engaging surface adjacent the outer surface of the spring.

11. The assembly of claim 6 wherein the engaging surface is concentric with and matingly engages at least one of the inner and outer surfaces of the spring.

12. The assembly of claim 6 wherein the spring includes a filament having a filament diameter, the seal extending along an axis of the plunger by a distance equal to approximately half the filament diameter.

13. The assembly of claim 6 wherein the spring includes a filament coiled at least twice about the plunger to form two coils, the engaging surface engaging the two coils of the spring.

14. The assembly of claim 6 wherein the retaining member has an engaging surface that engages the outer surface of the spring toward a second end of the spring to restrict lateral motion of the spring relative to the plunger, the retaining member further having a bore therethrough spaced apart from the outer surface of the spring, the spring extending through the bore of the retaining member.

15. The assembly of claim 6 wherein the seal includes a seal body and a flange that extends away from the seal body concentric with the plunger, the flange having an inner surface and an outer surface, the inner surface of the flange including the engaging surface and engaging the outer surface of the spring.

16. The assembly of claim 6 wherein the engaging surface is one of a plurality of engaging surfaces, each engaging surface being spaced apart from the others and engaging at least one of the inner and outer surfaces of the spring.

17. A seal of a high pressure pump comprising a body having a bore sized to allow a plunger to extend therethrough, the body sealably engaging the plunger as the plunger moves axially through the bore, the body further having a flange portion projecting away from one end of the body, the flange portion having engaging surfaces positioned to engage an inner surface and an outer surface of a spring coiled around the plunger and restrict lateral motion of the spring relative to the plunger, the inner surface of the spring facing toward the plunger, the outer surface of the spring facing diametrically opposite the inner surface.

18. The seal of claim 17 wherein the spring includes a filament having a filament diameter, the flange portion extending from the body substantially parallel to the plunger by a distance equal to approximately half the filament diameter.

19. A high pressure fluid seal assembly comprising:

a seal carrier having a bore through which a reciprocating plunger may pass, the seal carrier having a first annular groove concentric with the bore and a second annular groove that is concentric with the bore and that is axially spaced from the first annular groove;

an annular seal positioned in the first annular groove, the annular seal having a first end region and a second end region opposite the first end region, the first end region being supported by the seal carrier, the second end region having a flange extending away therefrom concentric with the bore;

a spring having a first end and a second end opposite the first end, the first end being biased against the annular seal, the spring further having an inner surface facing toward the plunger and an outer surface facing away from the inner surface, one of the inner surface and the outer surface of the spring toward the first end of the spring engaging the flange of the seal;

a retaining member annularly disposed about the plunger and biased against the second end of the spring the retaining member being spaced apart from the plunger and being in contact with an outer surface of the seal; and an annular guidance bearing positioned in the second annular groove of the seal carrier, an inner diameter of the annular guidance bearing being smaller than an inner diameter of the bore of the seal carrier in a region between the first annular groove and the second annular groove.

20. The assembly of claim 19 wherein the flange has an engaging surface adjacent the outer surface of the spring.

21. The assembly of claim 19 wherein the flange has an engaging surface adjacent the inner surface of the spring.

22. The assembly of claim 19 wherein the flange has a first engaging surface adjacent the inner surface of the spring and a second engaging surface adjacent the outer surface of the spring.

23. The assembly of claim 19 wherein the spring includes a filament having a filament diameter, the flange extending along an axis of the plunger by a distance approximately equal to at least half the filament diameter.

24. A method for restricting motion of a spring disposed about a plunger of a high pressure fluid pump, the method comprising:

sealably engaging a seal with the plunger;

engaging the seal with an inner surface and an outer surface of the spring toward a first end of the spring, the inner surface facing toward the plunger, the outer surface facing diametrically opposite the inner surface; and restricting lateral motion of the spring relative the plunger.

25. The method of claim 24 herein the act of engaging at least one of the inner surface and the outer surface of the spring includes engaging only a portion of one coil of the spring.

26. The method of claim 24 wherein the spring has a second end opposite the first end, further comprising engaging at least one of the inner surface and the outer surface of the spring toward the second end of the spring to further restrict lateral motion of the spring relative to the plunger.

27. The method of claim 24 wherein the plunger extends into a cylinder, further comprising restricting lateral motion of the spring relative to a wall of the cylinder.

* * * * *